US009082371B2

(12) United States Patent
Schimmel-Vogel

(10) Patent No.: US 9,082,371 B2
(45) Date of Patent: Jul. 14, 2015

(54) KEYBOARD INSTRUMENT

(71) Applicant: VIOGA GmbH, Braunschweig (DE)

(72) Inventor: Hannes Schimmel-Vogel, Braunschweig (DE)

(73) Assignee: VIOGA GmbH, Braunschweig (DE)

( * ) Notice: Subject to any disclaimer, the term of this patent is extended or adjusted under 35 U.S.C. 154(b) by 0 days.

(21) Appl. No.: 14/374,274

(22) PCT Filed: Feb. 25, 2013

(86) PCT No.: PCT/EP2013/053695

§ 371 (c)(1),
(2) Date: Jul. 24, 2014

(87) PCT Pub. No.: WO2013/124481

PCT Pub. Date: Aug. 29, 2013

(65) Prior Publication Data

US 2015/0033930 A1 Feb. 5, 2015

(30) Foreign Application Priority Data

Feb. 23, 2012 (DE) ..... 10 2012 003 405

(51) Int. Cl.

| | |
|---|---|
| ***G10C 1/04*** | (2006.01) |
| ***G10C 3/12*** | (2006.01) |
| ***G10C 3/06*** | (2006.01) |
| ***G10C 3/08*** | (2006.01) |

(52) U.S. Cl.
CPC .. *G10C 3/12* (2013.01); *G10C 1/04* (2013.01); *G10C 3/06* (2013.01); *G10C 3/08* (2013.01)

(58) Field of Classification Search
CPC ..... G10C 3/06; G10C 3/04; G10C 9/00; G10D 1/005
USPC ..... 84/192, 423 R
See application file for complete search history.

(56) References Cited

U.S. PATENT DOCUMENTS 2,217,021 A 10/1940 Klepac

FOREIGN PATENT DOCUMENTS

| | | | |
|---|---|---|---|
| DE | 332408 | A | 5/1920 |
| DE | 346160 | C | 3/1921 |
| DE | 512674 | A | 11/1930 |
| DE | 167603 | B | 2/1951 |
| DE | 11869 | | 7/1956 |
| DE | 1497793 | A1 | 10/1969 |
| DE | 3831187 | A1 | 3/1990 |
| DE | 9209461 | U1 | 11/1992 |
| DE | 19819851 | A1 | 11/1999 |

OTHER PUBLICATIONS

PCT International Search Report (English Translation), Sep. 4, 2014.

*Primary Examiner* — Kimberly Lockett
(74) *Attorney, Agent, or Firm* — Barlow, Josephs & Holmes, Ltd.

(57) ABSTRACT

The Invention relates to a keyboard instrument with a keyboard and a sound board including a front edge which runs substantially parallel to the keyboard. The sound board further includes a first lateral edge which forms a first angle (A) with the front edge, and a second lateral edge which forms a second angle (B) with the front edge. Strings are provided which are induced to vibrate by respective keys of the keyboard. There is also at least one sound bridge which is secured to the sound board and on which the other end of the strings which faces away from the keys is supported. The first angle (A) is >90°. The sound bridge extends at a right angle on the sound board approximately as far as a line that runs rearwards from the intersection of the front edge of the sound board and the first lateral edge.

14 Claims, 4 Drawing Sheets

KEYBOARD INSTRUMENT

Figure 1:
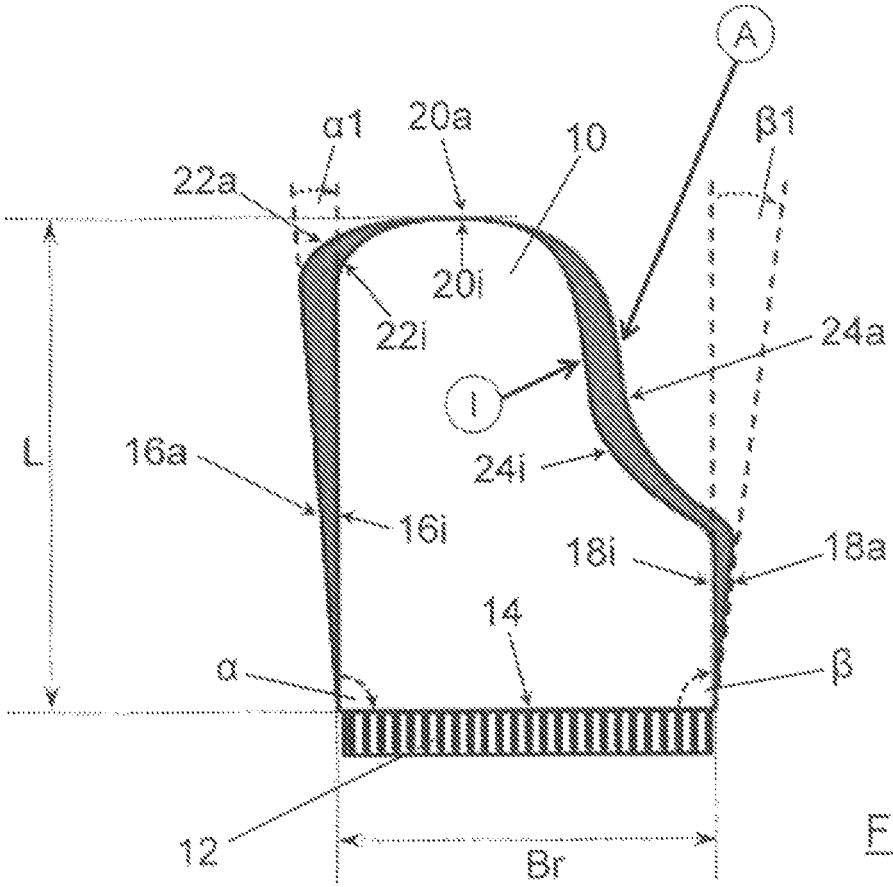

The present invention relates to a keyboard instrument, such as, in particular, a grand piano. It relates particularly to a keyboard instrument with a keyboard, with keys, with strings that can be induced to vibrate by keys of the keyboard that are assigned to each string, with the keys and the assigned strings of the lower tones being formed as bass choirs or voices and those of the middle and higher tones being formed as tenor and descant or treble choirs, with a sound board, having a front edge, which runs substantially parallel to the keyboard when mounted, and having a first lateral edge, which forms a first angle with the front edge, and a second lateral edge, which forms a second angle with the front edge, and with at least one sound bridge, which is secured to the sound board and on which the other end of the strings that faces away from the keys of the keyboard is supported.

Resonating strings are the actual sound generators in a keyboard instrument. They are induced to vibrate by hammer heads, which are part of the playing mechanism, by pressing associated keys. Depending on the impulse and on the geometric location of the hammer heads striking the resonating strings as well as on the physical properties of the strings, a typical vibrational curve is created, which is referred to as the sound spectrum. This sound spectrum is amplified and filtered by a sound board, so that specific spectral components are retained, whereas others, in turn, are suppressed more or less. The result of this filtering operation is the distinctive sound pattern of a keyboard instrument.

Keyboard instruments and the associated sound boards are generally known. A good overview is provided, for example, by the brochure "PIANOFORTEBAU—EIN KUNSTHANDWERK" [Pianoforte Construction—An Artistic Craftwork], by Nikolaus W. Schimmel, published by the company "Wilhelm Schimmel Pianofortefabrik GmbH, Braunschweig" in the year 2000. Illustrated there on page 79, for example, is the structure of a grand piano, in which, in particular, the sound board, the sound bridges, the resonating strings, and the keys are shown.

The sound board is an especially important element. It has to transform the energy absorbed by the piano strings into airborne sound. This necessitates a sensitive response of the sound board over a broad frequency range from generally less than 50 Hz to more than 12,000 Hz. At the same time, a sound board has to be exceptionally stable in order to withstand permanently the pressure of the resonating strings it is subjected to. The stability of the sound board crown, the properties in its edge zones, its elasticity modulus, its internal damping, the speed of propagation of different frequencies in longitudinal and traverse directions with respect to the grain of the wood used, the dimensions and positions of its bridges and ribs, and much more govern the characteristic vibrational properties.

Described in DE 1 497 793 A1 is a special resonating body for pianos and similar musical instruments, which contains a sound board, also referred to there as a resonating plate. A plurality of ribs, which lie apart from one another, are secured to the rear side of the sound board and one or a plurality of bridges are secured to its front side for holding the strings of the piano. The invention described there is special in that the ribs secured to the sound board have various acoustic properties.

DE 198 19 851 A1 also describes a special resonating body, which contains a sound board, for a string instrument. It is also mentioned there that such a sound board is generally plate-shaped and has a rectangular shape or the corresponding shape of a piano.

Another special design of a concert grand piano is described in DE 92 09 461 U1. The resonating surface there is spatially separated from a support structure of the grand piano and is arranged as a plate that is accessible to free vibration. As a result, the resonating surface can be designed to be larger than was previously the usual case.

Although this solution makes possible quite a large resonating surface, its arrangement is costly to fabricate and transport.

DDR Patent Specification DD 11 869 presents a special sound board for upright pianos and grand pianos, which has an angle of about 98 degrees between the front edge and the lengthwise side in the bass register. Furthermore, additional reinforcing ribs are attached to the sound board with grain directions of the wood in order to thereby improve rendition of the overtone-rich sounds of the keyboard instrument.

Another important element of a keyboard instrument is the playing mechanism, which is composed essentially of a keyboard and a mechanical system. The keyboard transmits the impulse (stroke) imparted by a player. In the process, it is crucial that the dynamic desired by the player—from pianissimo to fortissimo—is thereby brought exactly to the instrument. A key generally functions as a rocker, but it is flexible in the rear part, so that the impulse is amplified in the sense of a spring. The mechanical system of the playing mechanism transmits the impulse imparted via the keys and thus its associated energy to a strike of a hammer on a key. The essential functions as well as the structure of a grand piano playing mechanism are described, for example, in the above-mentioned brochure "PIANOFORTEBAU—AN ARTISTIC CRAFTWORK," p. 36 f.

The interaction of keyboard and mechanical system is optimized by way of the so-called lever ratios. The outcome resulting from this is also referred to as the touch or play feel. On account of its relative scale, a concert grand piano offers optimal relationships and hence the best possible touch.

In the case of grand pianos, regardless of their size, there are generally 88 keys, to which are assigned corresponding strings, which are induced to vibrate by pressing the keys. The pitch results from various properties of the strings, in particular their length, but also their thickness, their material, their tension, and any wrapping.

The scaling is also to be noted in the design of keyboard instruments. This term refers to the length of the resonating strings in relation to one another as well as to their dimensioning. Dimensioning is generally understood to refer to the design of the string lengths, the area density (mass per unit length), and the tensile force (pitch).

Usually, the highest tone is assigned to the rightmost key at the far right. Located there is the shortest string, which runs from a near-key end to its second end on a sound bridge. In a conventional grand piano, 87 additional keys then follow from right to left, with the strings tending to become longer and longer. This is also seen in a grand piano in that its body is relatively short on the right and projects increasingly further or deeper into space toward the left, or toward the rear from the perspective of the pianist. However, this lengthening of the strings is not linear. A typical sound bridge for the strings of the middle pitches (tenor) and of the higher pitches (descant) traces the shape of a parabola or hyperbola, for which reason the typical shape of a grand piano causes an overproportional extension and hence a curvature (as viewed from above) and consequently an extension of the left outer end in depth.

However, in the case of the bass strings, which are located on the left side, additional measures are required. The reason is that, if a usual steel string were used for this, it would have to be about 7 to 8 meters long. Because this is not feasible, however, the bass strings are wrapped. As a result, these strings can be markedly shorter and nonetheless produce the appropriate low tone. However, as a result of this wrapping, the tonal quality and the possibility of sound level development are degraded somewhat. For these bass strings, there is usually a separate sound bridge, which is located inside the grand piano on the right.

The quality of a string instrument, such as, in particular, a grand piano, is strongly influenced, moreover, by the following design features: size of the sound board (sonority) and length of the keys (play feel or touch). The size of the sound board takes clear priority. The ideal size for it is achieved for concert grand pianos, which generally have a total length of between 270 and 290 cm.

In the case of smaller grand pianos, which are used in living areas, in schools or universities, etc., for example, a compromise thus needs to be found. In living areas and other rooms with limited area, the keyboard instrument needs to be substantially smaller. Insofar as possible, the quality should thereby undergo only minor impairment, even though the extension of the sound board toward the rear, that is, its depth, is correspondingly shortened. Moreover, the length of the keys, which are part of the playing mechanism, is usually shortened. Although, as a result, it is achieved that the size of the sound board needs to be reduced in size as little as possible, such a shortening of the key length leads, on the other hand, to a different play feel in the case of smaller grand pianos compared with concert grand pianos. Such smaller grand pianos are also referred to as baby grand pianos.

Apart from the fact that, in any case, an impairment of the quality already results from the shortening of the key length and that the shortening of the depth of the sound board also tends in this direction, an additional problem arises, namely that professional and other ambitious pianists, who each also perform concerts on concert grand pianos in appropriately large premises, are able to practice only with difficulty, because the baby grand pianos used for practice purposes convey, as mentioned, a different play feel and a different sonority. They are thus not only somewhat softer or have a reduced volume of sound, but they also play differently and, in this way, make it difficult for users to prepare for their concerts.

It is the object of the present invention to design keyboard instruments, such as, in particular, grand pianos, that are smaller than conventional concert grand pianos and are referred to in the following as baby grand pianos, such that the play feel achievable with them comes closer to that of concert grand pianos.

This object is achieved according to the invention by a keyboard instrument that is characterized in that the first angle is >90°, so that the sound board extends over a line that runs at a right angle rearwards from the intersection of the front edge of the sound board and the first lateral edge, and that the end of the sound bridge facing away from the keys of the keyboard extends at least so far in the direction of the first lateral edge that the longest string of the tenor choir is supported unwrapped in the region of this end of the sound bridge.

Advantageous further developments are given in the dependent claims.

The present invention is based on the following findings.

A first sound bridge for the strings of the tenor and descant choirs runs—as already mentioned above in connection with many conventional grand pianos—roughly in the shape of a parabola or hyperbola from the right in proximity to the keys to the left in the rear region of the grand piano. A second sound bridge for the strings of the bass choirs lies in the right rear region of the grand piano and also runs along a curve.

In known concert grand pianos, it is standard to divide the keyboard registers into the three mentioned choirs—bass, tenor, descant. In this case, the twenty keys on the extreme left belong to the wrapped bass choirs, which run toward the second sound bridge and generally each contain two strings. The other 68 choirs, which generally each contain three non-wrapped steel strings, run toward the first sound bridge. In addition, there is generally also a separation of the descant strings and the tenor strings from one another, which, on account of a stabilization joint in a cast part in the region of the keys, are separated somewhat further apart from one another than the individual choirs are separated from one another.

The strings of the choir of the 21st key (from left) are the longest, since they run from the front region of the grand piano near the keyboard to the left end of the first sound bridge and are secured in the rear left region of the concert grand piano. This securing point is preferably about 12 cm distant from the outermost edge of the sound board. The strings of the choir of the twentieth key run from the front region of the grand piano near the keyboard to the right end of the second sound bridge and are therefore markedly shorter than the strings of the neighboring 21st key. It is important in this case, however, that the difference in length is not too great, because a markedly different sound sensation would otherwise result. Professionals and very experienced players of concert grand pianos are familiar with this critical transition. Nonetheless—or for this very reason—the 20th key and the 21st key, the associated playing mechanisms, and the choirs originating from them always need to be fabricated with special care.

As stated, these described arrangements and properties relate to concert grand pianos, which are relatively large and are played with pleasure by concert pianists in concert halls. For other premises, such concert grand pianos are often too large, so that, in these cases, baby grand pianos, which have less depth, are used instead. This leads, on the one hand, to the sound board being correspondingly shorter, as a result of which the sonority is not as grand as that of a concert grand piano. However, the reduced depth of the grand piano and thus of the sound board also has the result that the strings of some tenor keys can no longer be accommodated so that they run to the first sound bridge. They would be too long for this. Depending on the size of the baby grand piano, this generally affects keys 21 to 26, often also keys 21 to 28, or even more keys (as viewed from the left on the keyboard). Therefore, they are also wrapped and thus assigned to the bass choirs. Accordingly, the associated strings run to the second sound bridge. The tenor and descant choirs are accordingly assigned only the remaining keys of the 88 keys and thus, for example, to 62 or 60 keys in the example mentioned. This leads to a longer second sound bridge and to a somewhat stronger interlacing of the strings that cross one another at an angle. Although known baby grand pianos allow a sound sensation like that of a grand piano, the number of tenor choirs, which often have especially good sound characteristics, is reduced because of the increased number of bass choirs. This can be compensated for in part by shifting the boundary between the tenor choirs and the descant choirs to the right in favor of the tenor choirs, albeit this leads to a further change in the play feel and, for this reason, is accepted only as a stopgap solution and is not highly regarded.

In order to compensate at least partly for the reduction in the size of the sound board in the case of baby grand pianos, it has been conventionally common to shorten their keys and lever mechanisms.

Owing to the properties described for the baby grand pianos known thus far, the play feel is totally different on a small baby grand piano not only for professional concert pianists, but also for ambitious amateurs, than it is on a concert grand piano. The keyboard works totally differently and, in addition, the resulting sound that can be obtained when one and the same tone is played on the keys of the keyboard in the transition region between bass and tenor, for instance, is also very different.

The sound board according to the invention has, as usual, a front edge as well as two lateral edges. What makes it special is that at least one of the lateral edges forms an angle with the front edge that is greater than 90 degrees. As a result, a larger area is made possible for the sound boards of smaller grand pianos, given the same width and same length as for the sound boards known thus far, said area already having in itself a very advantageous effect on the sound properties.

However, owing to the fact that, as viewed by the pianist, the left lateral edge of the grand piano forms a visually relatively small angle with respect to the verticals to the front edge, not only is this somewhat larger area for the sound board created, as mentioned. Of even much greater importance is that, in this very region in which the first, longer sound bridge ends at the "rear left," as viewed by the pianist, there is now the possibility of extending this sound bridge even somewhat further, without thereby leaving the sound board or even just reaching the edge of the sound board. In this case, the sound bridge can be adjusted somewhat in its course, because, indeed, the grand piano does not extend deeper or, as viewed by the pianist, further rearwards, as in the case of a concert grand piano, but rather merely extends somewhat further toward the left rear owing to the additional angled area placed more or less to the left at the sound board.

However, this makes it possible to lay the strings, especially those of the 21st to 26th or 28th keys, which were already pointed out above as being especially critical, once again on the first sound bridge, because the requisite length—namely, especially in this expanded area and towards the lengthened sound bridge—is now also available for this shortened baby grand piano despite the fact that it lacks the depth of a concert grand piano. This means that the corresponding strings do not need to be wrapped, but rather can retain the full sonority of strings from the tenor register that the pianist of concert grand pianos is accustomed to.

The advantageous effect is thus substantially greater than would be conceivable alone through an enlargement of the area of the sound board and this effect is of great surprise to the pianist. The consequence is, namely, that the complete division of the keys between bass, tenor, and descant can occur just as it does in the case of concert grand pianos and not as it does in the way the pianist has hitherto expected for baby grand pianos to his or her disappointment.

Both the play feel and the tonal quality of grand pianos are substantially enhanced and this is true even though it is still possible, without anything further, to work with the rather tighter spatial relations for baby grand pianos.

In addition, the invention also breaks a dogma that is common in this field. In the past, the playing mechanisms installed in smaller grand pianos have had a key length that is markedly shorter than for large grand pianos. The invention, by contrast, makes it possible to install playing mechanisms with long keys in smaller grand pianos, as in the case of large concert grand pianos, while retaining the same or nearly the same sound. Such keys usually have a length of 52 cm or more.

Moreover, the use of the same keyboards for different models of grand pianos (or other keyboard instruments) makes it possible to markedly simplify stock-keeping and fabrication as well as service, repair, and stocking of replacement parts. In addition, it is possible to use similar cast iron stability elements, as a result of which the stock-keeping, fabrication, service, etc. can be simplified still further.

The enlarged area that results from the special arrangement of at least one lateral edge also makes it possible for nearly the same scaling to be utilized for baby grand pianos as for concert grand pianos. In the case of baby grand pianos, this also leads to a play feel and sound sensation that closely approaches that of concert grand pianos, even when some bass strings are omitted in the scaling on account of design constraints.

It has been found to be especially advantageous when one or even both lateral edges form an angle of about 92.5 degrees with the front edge. Accordingly, the lateral edges run at about 2.5 degrees from the right angle. As a result of this widening, the area of the sound board is already expanded by an astonishing 15%. Therefore, the sound board of a grand piano with a length of 169 cm, for example, corresponds to a conventional grand piano that is 194 cm in length. The value of the angle of about 92.5 degrees is an especially good compromise in order to enlarge the area of the sound board, on the one hand, and yet not have a detrimental effect on the esthetic appearance of the grand piano, on the other hand.

If the angle on the right side of the grand piano that encloses the side with the front edge facing the pianist is adjusted by a roughly comparable, relatively small angle such that the width of the grand piano is enlarged from the pianist rearwards, a similar, although not quite so great effect, can also be exploited on the right side in a preferred embodiment. In this case, it is now the second sound bridge for the remaining 20 strings that can be extended as far as or beyond the line that runs at a right angle rearwards from the right front corner of the sound board and thereby, at the same time, forms the right lateral edge in the case of conventional grand pianos.

As a result, these bass strings that remain wrapped can also be lengthened somewhat, even though the grand piano still remains a baby grand piano. This lengthening of the bass strings also leads to an improvement in the quality of the sound and the play feel.

In addition, the invention creates the technical and musical possibility that a large number of grand pianos of different size can have the same number of bass choirs.

Thus, it is specifically possible for the different grand piano models of a company, with different depths of the sound board, each nonetheless to have only 20 different bass choirs. This can be realized by way of the enlarged area of the sound board in comparison to the baby grand pianos known thus far and by way of the relative lengthening of the bass choirs that is thereby made possible. Accordingly, the basis is established to achieve the same tonal spectrum in all tonal registers (bass, middle register, descant) and to use a fully identical keyboard, mechanical system, and division as well as identical hammer heads.

In the realization of a concert grand piano and five additional smaller grand piano models, it is possible to make the entire sound bridge formation of keys 49 to 88 (as viewed from left) completely identical. Only from the 49th key leftwards to the first key is there a correspondingly differently designed formation of the first sound bridge—and naturally also of the second sound bridge provided for the bass choir in any case—for each size. Although the strings are formed with somewhat different lengths for the steel strings as well in the different models, this can be compensated for by different diameters of the steel strings. However, these measures cannot be implemented for any arbitrary steel string lengths, because then the strings cannot be held or, on account of the mass effect, can no longer be tightened. In the registers of interest here, however, everything is possible without anything further. Important are, above all, the relative relationships and ratios of the individual strings to one another.

It is especially advantageous that the concert pianist now has the possibility of being able to play and practice on a baby grand piano at home in the practice room and then, at a performance in a concert hall, of being able to sit at a concert grand piano that behaves exactly the same as the baby grand piano on which the pianist practiced beforehand. As briefly discussed above, there was hitherto the problem that the pianist, prior to practicing at home, had to adjust to a different tonal quality and to a different behavior of the grand piano than for the concert in a concert hall, especially in the transition register between bass and tenor. It is always awkward when tests cannot be carried out under actual conditions. It is this very problem, which has hitherto been very irritating to professional pianists, that can be eliminated completely according to the invention.

The proposals according to the invention are not only of substantial value to the pianists, however, and lead to an enhanced quality also for each individual baby grand piano. The invention also contributes, moreover, to an especially economical and, at the same time, environmentally friendly, improved stock-keeping.

Thus, it is now possible to use practically identical keys and keyboards for an entire series of very different grand pianos, whereas it is was hitherto necessary to keep stocked keyboards and keys adapted to the individual sizes of different baby grand pianos.

This applies, on the one hand, already to the length of the keys, which is now identical for all of the different baby grand piano sizes and, at the same time, for concert grand pianos, and, on the other hand, also to the division of the keys in the keyboard frame, because, in contrast to what was conventionally the case, the keys are divided, as mentioned, identically on bass, tenor, and descant choirs for each baby grand piano size and for concert grand pianos.

Additional, especially preferred features are given in the dependent claims.

Figure 2:
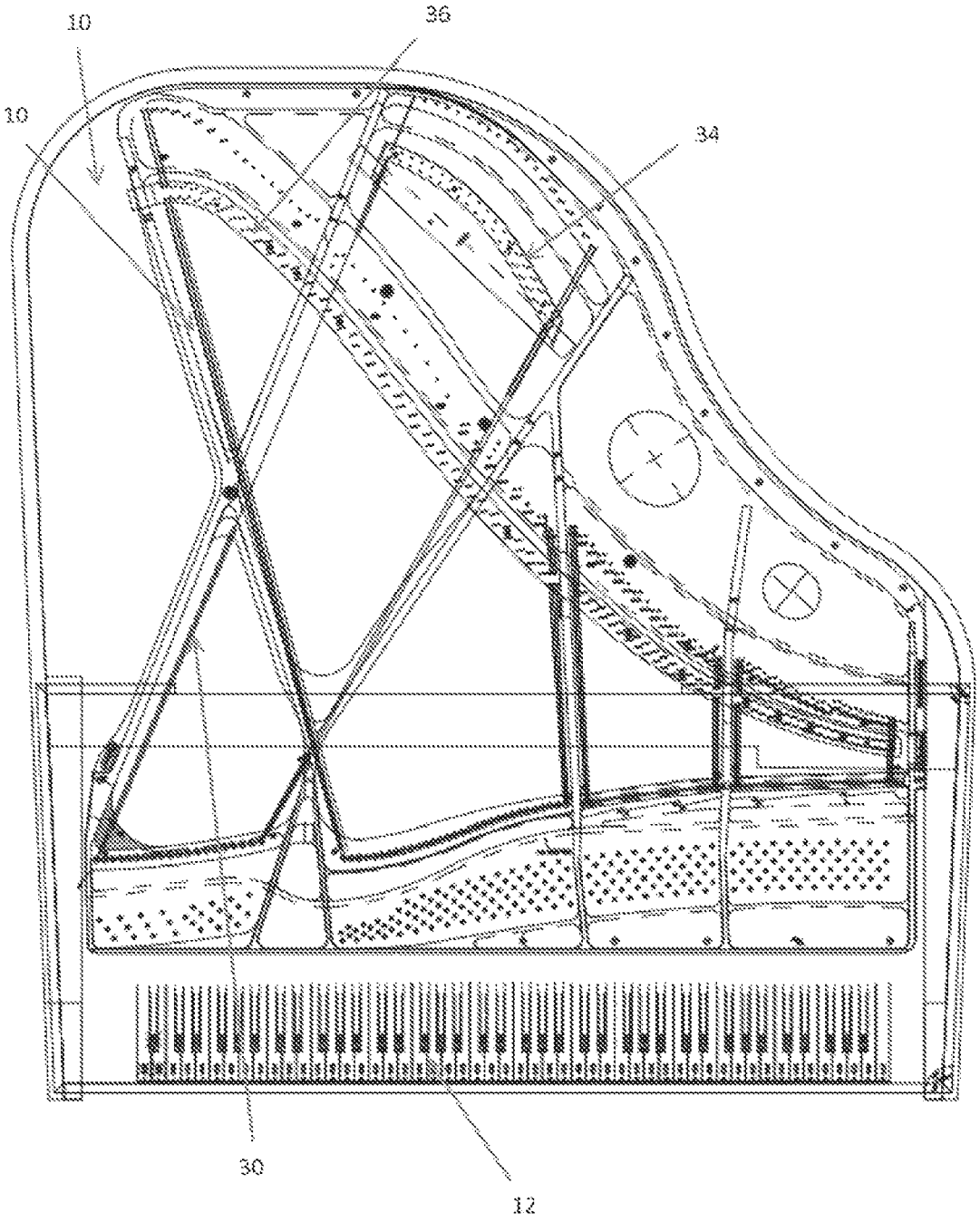
Figure 3:
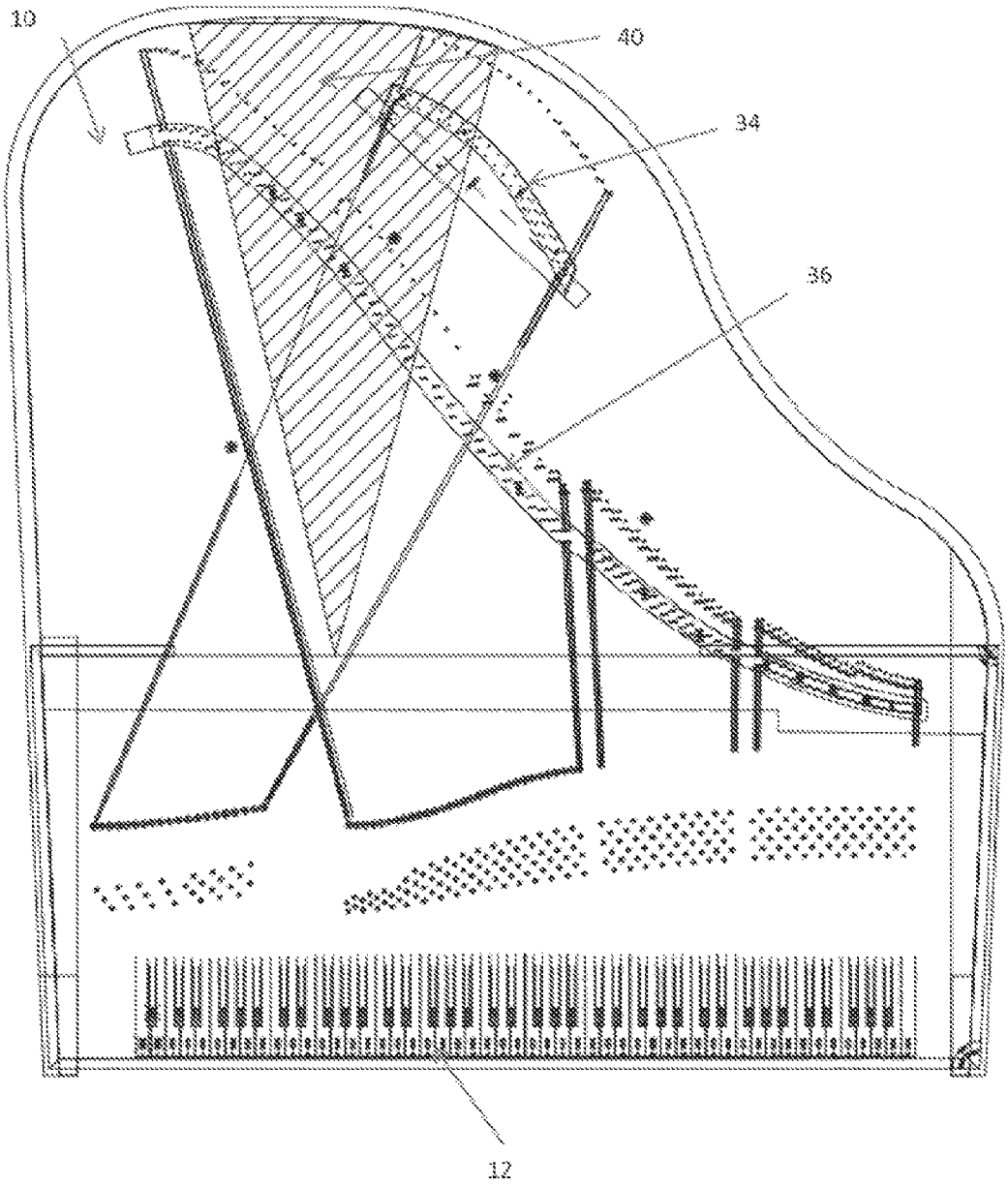

Further details and advantages are described on the basis of the preferred exemplary embodiments below. Shown are:

FIG. 1 a sound board for a piano in plan view;

FIG. 2 a grand piano in plan view;

FIG. 3 the grand piano from FIG. 2 in a highly schematic form; and

Figure 4:
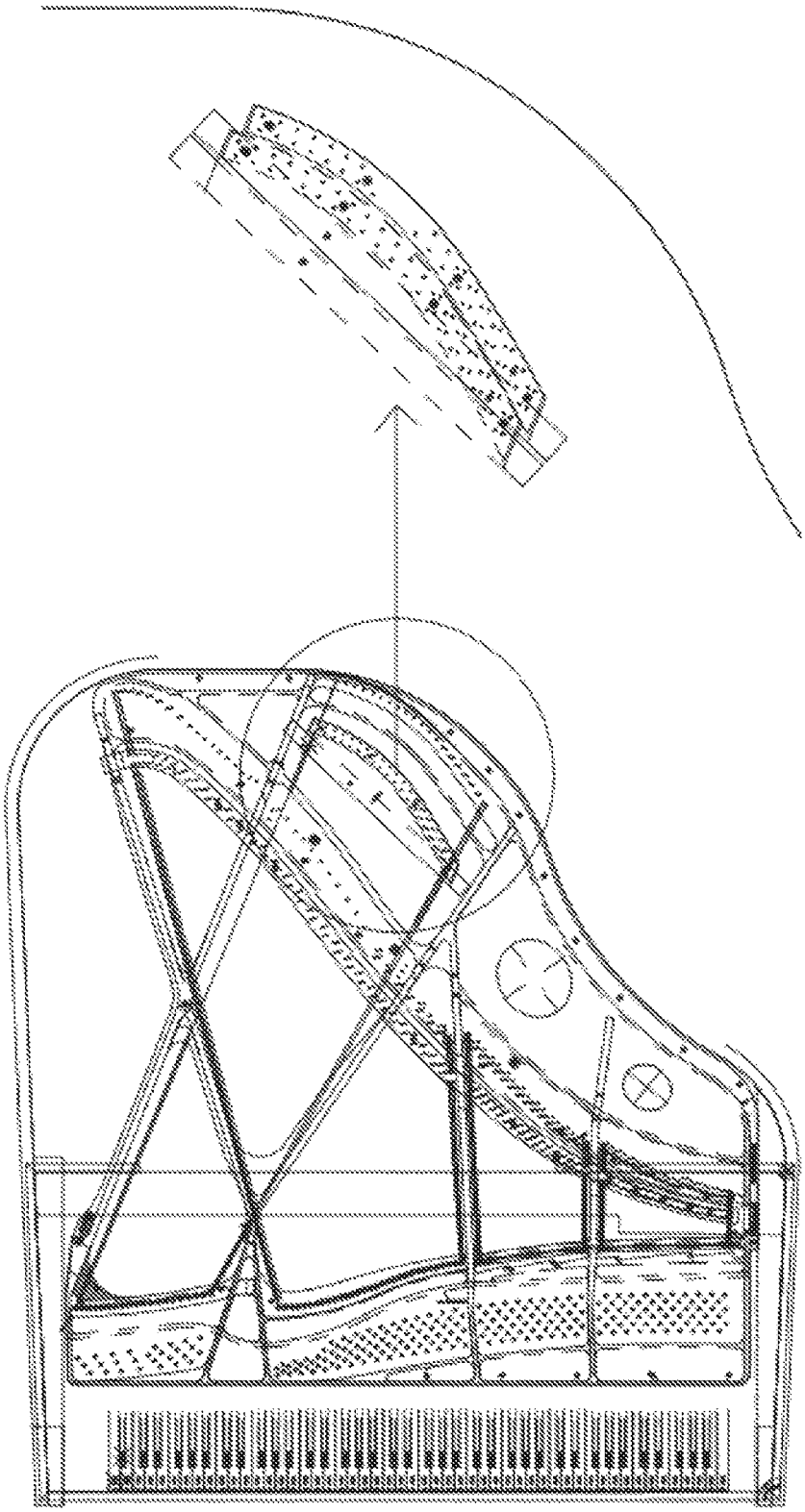

FIG. 4 the grand piano from FIG. 2 reduced in size with a cutout detail.

FIG. 1 shows, in symbolic manner, a sound board 10 in plan view. The sound board 10 is mounted in a grand piano, such as a concert grand piano or a baby grand piano, only a keyboard 12 of which is indicated here. Other elements of the grand piano, such as, for example, strings, sound bridge, lid, and the like, are not illustrated in FIG. 1 for reasons of clarity.

A preferred design of the sound board 10 for a keyboard instrument according to the invention is illustrated in FIG. 1 by an outer contour A. It comprises an outer front edge 14, which, when mounted, extends nearly parallel to the keyboard 12, as well as an outer left lateral edge 16*a*, adjoining it on the left, and an outer right lateral edge 18*a* adjoining it on the right, which, in this case, is substantially shorter in comparison to the left outer lateral edge 16*a*. The outer contour further comprises an outer rear edge 20*a*. The latter is joined via an outer curvature 22*a* to the left outer lateral edge 16*a* and via an outer curved portion 24*a* to the right outer lateral edge 18*a*. The preferred sound board 10 with the outer contour A has a length L, which, in this case, is about 117 cm and a width Br in the region of the keyboard 12, said width being about 156 cm in this case.

Drawn inside of the outer contour A is a darkly marked region, which delineates an inner contour I inwards. This represents a sound board such as is known in the prior art. It also has a front edge, which, in this case, is identical to the outer front edge 14. Further present are a left inner lateral edge 16*i*, a right inner lateral edge 18*i*, and an inner rear edge 20*i*. The inner contour I has essentially the same width B and the same length L as the outer contour A.

The key difference between the sound board 10 according to the outer contour A and a sound board that is known as such according to the inner contour I is as follows:

Whereas the left inner lateral edge 16*i* forms an angle α of nearly 90 degrees with the front edge 14, the left outer lateral edge 16*a* forms an angle with the front edge 14 of $$A=\alpha+a1=90+2.5 \text{ degrees}=92.5 \text{ degrees}.$$

Accordingly, the deviation between the outer left lateral edge 16*a* and the inner left lateral edge 16*i* is therefore α1=2.5 degrees.

In a similar manner, the right inner lateral edge 18*i* forms an angle β of nearly 90 degrees with the front edge 14. By contrast, the right outer lateral edge 18*a* deviates by an angle β1—in this case, also 2.5 degrees—from the right inner lateral edge 18*i*, so that the right outer lateral edge 18*a* forms an angle B with the front edge 14, with $$B=\beta+\beta1=90+2.5 \text{ degrees}=92.5 \text{ degrees}.$$

The angle is basically the same.

The new sound board according to the outer contour A, with the same length L and the same width B in comparison to the known sound boards according to the inner contour I, has the advantage that it has an essentially larger area. The difference in area, which is illustrated in FIG. 1 by the darkly marked region, is approximately 15% in the preferred exemplary embodiment. Accordingly, the result achieved is that a grand piano with the new sound board 10, with the same length L and width B, offers markedly more sound volume than does a grand piano with a known sound board.

FIG. 2 shows, in a symbolic manner, the interior of a grand piano in plan view with the sound board 10 and the keyboard 12 illustrated in FIG. 1. In this case, only those elements that are essential for understanding the present invention will be addressed.

In FIG. 2, the strings of the bass choirs (bass strings) are indicated by 30 and the strings of the descant and tenor choirs are indicated by 32. The bass strings 30 run from front left—the region of keys 1 to 20—to the second sound bridge 34, which is located in the rear right part of the grand piano. The other strings 32 run, widely spread apart, from the other keys to the first sound bridge 36, which extends over a wide region inside of the grand piano. Because the angles A and B in this exemplary embodiment are each 92.5 degrees—and thus greater than 90 degrees—the sound board 10 is markedly broader in its rear region than is the case for known designs.

As a result, it also enables there to be more space for the sound bridges 34 and 36. In the preferred embodiment, the first sound bridge 36 has an extension that reaches almost as far as the line 16*i* of FIG. 1 or even extends beyond it. This left rear end of the sound bridge 36 thus lies approximately at the place where, in conventional baby grand pianos, the sound board 10 has already ended, so that it is no longer possible to position any sound bridge 36 there at all.

In the concepts according to the invention, the end of the sound bridge 36 also does not lie at the edge of the sound board 10, but rather lies at a spacing of between 10 cm and 15 cm, preferably about 12 cm to 13 cm, from the nearest-lying edge of the sound board 10. Such a spacing has generally proved favorable for the quality of the sound board 10 and the tonal quality thereby achievable.

The sound board 10 has a rounded curvature and has an edge, which extends from the front edge 14 at an angle rearwards, as left lateral edge 16*a* (see FIG. 1, respectively), and, as a result, increases the width of the sound board 10 from front to rear. Shortly before reaching the rear end, the left lateral edge 16*a* makes a transition into a curved arch to the right and, as a result, goes around the outer end of the sound bridge 36 at a spacing of about 12 cm to 13 cm in this exemplary embodiment. This is especially advantageous for the acoustics. In this way, the sound bridge 36 can extend further leftwards than in conventional baby grand pianos, so that the distance of this outer end of the sound bridge 36 from the keys of the keyboard 12 at the point of transition from the bass choir to the tenor choir attains exactly the length that is required for a set of strings formed as tenor choir.

The curved edge then extends even further rightwards in its further course than is the usual case for conventional baby grand pianos. In this way, it is possible also to arrange the second sound bridge 34 differently than is conventionally the case. It can be arranged, namely, by the additional stretching of the edge of the sound board 10 even further away from the keyboard 12. In this way, it is possible, despite the retention of a spacing of the second sound bridge 34 from the edge of the sound board 10, to employ a longer and thus thinner string for the bass strings as well. As a result, a better tonal transition between the tenor and the bass is created, for which indeed a change in bridge from the first sound bridge 36 to the second sound bridge 34 must necessarily occur. This means that a better tonal transition from the tone assigned to key 20 to the tone assigned to key 21 can take place.

The further outward swing of the edge of the sound board 10 in this region as well is made particularly possible in that the right lateral edge 18*a* also runs at an angle (B) (compare, in turn, FIG. 1) and, in this way, the outward swing in this region by and large to the right is possible, without the overall shape of the sound board 10 being impaired esthetically or acoustically.

The view from FIG. 2 is illustrated somewhat differently in FIG. 3.

Namely, if the effect is regarded geometrically, the sound board 10, viewed exactly, is not extended leftwards and rightwards, but rather the sound board 10 of a conventional small grand piano or baby grand piano is divided into two regions. The left region, starting roughly from the 49th key to the left, is shifted from a rectangular shape to a shape similar to a kind of parallelogram with its rear portion to the left. This is roughly evident at the diagonals and other lines of this "parallelogram." As is known for a parallelogram, such a shift makes the diagonals longer in the direction of the shift, this corresponding exactly to the lengthening of the maximal string length that now corresponds to the [distance]* between the end of the sound bridge 36 and the assigned key of the keyboard 12.

In exactly the same way, the right region of the sound board 10 is shifted to the right in its rear region in the manner of a parallelogram. The region between these two divided parallelogram areas of the sound board 10 is filled in by the triangular cross-hatched additional inserted area 40.

Presented in FIG. 4 is the illustration from FIG. 2, again reduced in size, with a detail being illustrated in the cutout above it.

This detail shows the second sound bridge 34 and its surroundings on a magnified scale. Drawn below in broken lines in this case, additionally to the illustration from FIG. 2 or from FIG. 4, is the place where the bass bridge would be positioned in the case of a standard sound board 10 or a standard resonating body. It can be seen that this would be approximately a full width of the sound bridge 34 in the direction of the left front edge of the keyboard 12 in this case.

By way of the extension of the sound board 10 according to the invention rearwards to the right in this region, which is realized in this embodiment, it is thus also possible to shift the second sound bridge 34. In this case, the shift does not just occur—as the magnified detail illustration shows—"in the rear", where space would be available only in the case of concert grand pianos, but particularly to the right, which, owing to the extension, is now also possible according to the invention in the case of baby grand pianos.

Even when a minimum spacing between the second sound bridge 34 and the rear edge of the sound board 10 is retained, it is accordingly possible to use a longer and, at the same time, thinner string for the bass choir as well. As a result, a better tonal transition between the tenor and the bass is created, even though, in this case, a change in the sound bridge 36 or 34 that is used occurs from the 21st to the 20th key or from the 21st to the 20th choir.

This is supported overall in that the course of the edge of the sound board runs initially rearwards at an angle outwards also on the right side of the front edge, so that the adjoining rounded and thus gently curved edge portions of the sound board make this modification possible in the rear region, without there ensuing any acoustic esthetic change overall in comparison to concert grand pianos.

LIST OF REFERENCE SYMBOLS

10 sound board
12 keyboard
14 front edge
16*a, i* left outer or inner lateral edge
18*a, i* right outer or inner lateral edge
20*a, i* outer or inner rear edge
22*a, i* outer or inner curvature between 16 and 20
24*a, i* outer or inner curved portion between 18 and 20
30 strings of the bass choirs (bass strings)
32 strings of the tenor and descant choirs
34 second sound bridge (for bass strings)
36 first sound bridge
40 additional area
L length of the sound board 10
Br width of the sound board 10 in the region of the keyboard
α angle between 16*i* and 14
α1 angle between 16*a* and 16*i*
A angle between 16*a* and 14
β angle between 18*i* and 14
β1 angle between 18*a* and 18*i*
B angle between 18*a* and 14

The invention claimed is:

1. A keyboard instrument comprising:

a plurality of strings;

a keyboard having plurality of keys wherein each key is assigned to a respective string, each of said strings being induced to vibrate by said respective key, said keys and strings being arranged into a bass choir, a tenor choir and a descant choir;

a sound board having a front edge which runs substantially parallel to said keyboard, a first lateral edge forming a first angle (A) with said front edge, and a second lateral edge forming a second angle (B) with said front edge, said strings having a first end supported adjacent said front edge of said sound board; and a sound bridge secured to said sound board, said strings having a second end supported on said sound bridge, said sound bridge having a near end adjacent said keys and a far end away from said keys, wherein said first angle (A) is >90° and said sound board extends over a line running rearwardly at a right angle from an intersection of said front edge of said sound board and said first lateral edge of said sound board, and said far end of said sound bridge extending towards said first lateral edge such that a longest string of said tenor choir is supported unwrapped in a region of said far end of said sound bridge.

2. The keyboard instrument of claim 1 wherein said far end of said sound bridge extends at least as far as said line running rearwardly at a right angle from an intersection of said front edge of said sound board and said first lateral edge of said sound board.

3. The keyboard instrument of claim 1 wherein said first angle (A) is between 90° and 95°.

4. The keyboard instrument of claim 3 wherein said first angle (A) is between 92° and 93°.

5. The keyboard instrument of claim 1 wherein said second angle (B) is between 90° and 95°.

6. The keyboard instrument of claim 5 wherein said second angle (B) is between 92° and 93°.

7. The keyboard instrument of claim 1 wherein said first angle (A) and said second angle (B) are substantially the same within a tolerance of +/−1°.

8. The keyboard instrument of claim 1 wherein said sound board, said bridge, said strings and said keys are designed as a grand piano.

9. The keyboard instrument of claim 1 comprising 88 strings and 88 respective keys and wherein 20 of said strings and keys comprise said bass choir and 68 of said strings and keys comprise said tenor and descant choirs.

10. The keyboard instrument of claim 1 wherein said sound bridge comprises a first sound bridge provided for said strings of said tenor and said descant choirs, said keyboard instrument further comprising a second sound bridge provided for said strings of said bass choir, and wherein said sound board has a rearward curved edge which extends towards said second lateral edge.

11. The keyboard instrument of claim 1 wherein said far end of said sound bridge has a spacing of between about 10 cm and 15 cm from said first lateral edge of said sound board.

12. The keyboard instrument of claim 11 wherein said far end of said sound bridge has a spacing of between about 12 cm and 13 cm from said first lateral edge of said sound board.

13. The keyboard instrument of claim 10, wherein said sound board has a rear edge, said second sound bridge has a right rear end, and said right rear end of said second sound bridge has a spacing of between about 10 cm and 15 cm from said rear edge of said sound board.

14. The keyboard instrument of claim 13, wherein said right rear end of said second sound bridge has a spacing of between about 12 cm and 13 cm from said rear edge of said sound board.

* * * * *